US007493776B2

(12) United States Patent
Lim et al.

(10) Patent No.: US 7,493,776 B2
(45) Date of Patent: Feb. 24, 2009

(54) ICEMAKER FOR REFRIGERATOR

(75) Inventors: Hyoung Keun Lim, Suwon-si (KR); Yang Gyu Kim, Seoul (KR); Se Young Kim, Seoul (KR); Chan Ho Chun, Seoul (KR); Youn Seok Lee, Goyang-si (KR)

(73) Assignee: LG Electronics Inc., Seoul (KR)

( * ) Notice: Subject to any disclaimer, the term of this patent is extended or adjusted under 35 U.S.C. 154(b) by 21 days.

(21) Appl. No.: 10/957,962

(22) Filed: Oct. 5, 2004

(65) Prior Publication Data

US 2005/0115266 A1 Jun. 2, 2005

(30) Foreign Application Priority Data

Nov. 27, 2003 (KR) ..... 10-2003-0085208

(51) Int. Cl.
*F25C 5/08* (2006.01)

(52) U.S. Cl. ..... 62/351; 219/385; 219/438

(58) Field of Classification Search ..... 62/351; 219/385–387, 436–438
See application file for complete search history.

(56) References Cited

U.S. PATENT DOCUMENTS

| | | | | |
|---|---|---|---|---|
| 3,020,730 | A * | 2/1962 | Harris, Sr. | 62/307 |
| 3,318,105 | A * | 5/1967 | Burroughs et al. | 62/71 |
| 3,775,992 | A * | 12/1973 | Bright | 62/73 |
| 3,875,370 | A * | 4/1975 | Williams | 219/386 |
| 4,388,521 | A * | 6/1983 | Thomas et al. | 219/521 |
| 4,450,347 | A * | 5/1984 | Courvoisier et al. | 219/549 |
| 4,833,894 | A * | 5/1989 | Chesnut | 62/135 |
| 4,923,494 | A * | 5/1990 | Karlovits | 62/73 |
| 5,056,322 | A * | 10/1991 | Patrick | 62/73 |
| 5,582,754 | A * | 12/1996 | Smith et al. | 219/438 |
| 5,759,501 | A | 6/1998 | Livingston et al. | |
| 6,082,130 | A | 7/2000 | Pastryk et al. | |
| 6,705,091 | B1 | 3/2004 | Kim et al. | |
| 2002/0117511 | A1 | 8/2002 | McNabb et al. | |

FOREIGN PATENT DOCUMENTS

| | | |
|---|---|---|
| CN | 1107961 | 9/1995 |
| CN | 1435659 | 8/2003 |
| DE | 8018995 U1 | 10/1980 |
| DE | 4430418 | 10/1995 |
| DE | 19617471 | 11/1997 |

(Continued)

OTHER PUBLICATIONS

English language Abstract of JP 5-203302.

(Continued)

*Primary Examiner*—William E Tapolcai
(74) *Attorney, Agent, or Firm*—Greenblum & Bernstein, P.L.C.

(57) ABSTRACT

Disclosed is an icemaker for a refrigerator includes an ice mold for receiving water and freezing the water to ice, an ejector pivotally installed on the ice mold to eject the ice out of the ice mold, a motor for operating the ejector, a heater body disposed enclosing the ice mold to separate the ice from an inner surface of the ice mold by uniformly heating the ice mold, and a heating coil for applying induced electromotive power to the heater body, thereby allowing the heater body to generate heat.

17 Claims, 7 Drawing Sheets

FOREIGN PATENT DOCUMENTS

| | | |
|---|---|---|
| EP | 1424428 | 6/2004 |
| JP | 5-203302 | 8/2003 |
| KR | 2003-15056 | 2/2003 |
| WO | 02/20893 | 3/2002 |
| WO | 02/058528 | 8/2002 |

OTHER PUBLICATIONS

U.S. Appl. No. 10/814,229 to Chung et al., filed Apr. 1, 2004.
English Language Abstract if DE 19617471.
English Language Abstract of DE 4430418.

* cited by examiner

-Related art-

ICEMAKER FOR REFRIGERATOR

BACKGROUND OF THE INVENTION

1. Field of the Invention

The present invention relates to an icemaker for a refrigerator, and more particularly, to an icemaker for a refrigerator, which can quickly separate pieces of ice therefrom by uniformly heating a surface where the pieces of ice contact an ice mold.

2. Description of the Related Art

FIG. 1 shows a refrigerator according to the related art.

Referring to FIG. 1, a refrigerator comprises a barrier 1 for dividing an inner space into a chilling compartment and a freezing compartment, a main body 2 in which a cooling cycle device for maintaining the chilling and freezing compartments at a low temperature is installed, a freezing door 4 pivotally mounted on the main body 2 to open and close the freezing compartment, and a chilling door 6 pivotally mounted on the main body 2 to open and close the chilling compartment.

The cooling cycle device applied to the refrigerator includes a compressor (not shown) for compressing low temperature/low pressure gas refrigerant, a condenser (not shown) for condensing the compressed refrigerant, an expanding device for reducing pressure of the condensed refrigerant, and a vaporizer for vaporizing the expanded refrigerant while absorbing heat of the chilling and freezing compartments.

In recent years, an automatic machine for making pieces of ice using cold air in the freezing compartment and dispensing the pieces of ice has been employed for user's convenience.

The automatic ice machine includes an icemaker 7 for freezing water fed thereto and an ice bank 20 for storing pieces of ice separated from the icemaker 7, a dispenser 300 installed on the freezing door 4 to allow the pieces of ice to be dispensed even without opening the freezing door 4, and an ice chute 40 for directing the pieces of ice from the ice bank 20 to the dispense 30.

When the water is fed to the icemaker 7, the water is frozen by the cool air in the freezing compartment. When the water is frozen, the pieces of ice are separated from the icemaker 7. Therefore, there are a couple of technical requirements for (a) feeding a proper amount of water to the icemaker so as for the water not to overflow the icemaker, (b) feeding a proper cool air to quickly freeze the water, (c) easily separating the ice from the icemaker, and (d) easily directing the pieces of ice to the ice bank 20.

Among the technical requirements, the separation of the ice from the icemaker by applying appropriate heat has been particularly developed. For example, a heating wire is arranged on an outer surface of the icemaker in a predetermined pattern where lines are spaced away from each other at a predetermined distance. When power is applied to the heating wire, the heating wire generates Joule heat to melt a portion of ice at a portion where the ice contacts the icemaker so that the ice can be effectively separated from the icemaker. U.S. Pat. No. 6,705,091 assigned to the applicant of this invention discloses such an icemaker with the heating wire.

However, the method for separating the ice from the icemaker by using the joule heat generated by the heating wire has a couple of drawbacks as follows:

1. Since the lines of the wire are spaced away from each other, the heat is not uniformly applied to an entire surface where the icemaker contacts the ice. Therefore, a large amount of heat must be applied to separate the ice from the icemaker, increasing the power consumption as well as the ice making time.

2. Since the heat is locally applied, the shape of the pieces of ice is not identical.

SUMMARY OF THE INVENTION

Accordingly, the present invention is directed to an icemaker for a refrigerator that substantially obviates one or more problems due to limitations and disadvantages of the related art.

An object of the present invention is to provide an icemaker that can quickly separate pieces of heating a surface of an ice mold, thereby making pieces of ice that are formed in an identical shape and saving the time for making the ice.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an icemaker for a refrigerator comprises an ice mold for receiving water and freezing the water to ice; an ejector pivotally installed on the ice mold to eject the ice out of the ice mold; a motor for operating the ejector; a heater body disposed enclosing the ice mold to separate the ice from an inner surface of the ice mold by uniformly heating the ice mold; and a heating coil for applying induced electromotive power to the heater body, thereby allowing the heater body to generate heat.

In another aspect of the present invention, there is provided an icemaker for a refrigerator, comprising an ice mold for receiving water and freezing the water to ice; and a heater for separating the ice from an inner surface of the ice mold by uniformly heating a surface where the ice contacts the inner surface of the ice mold using an induction heating manner by an induced electromotive power applied form an external side.

In still another aspect of the present invention, there is provided an icemaker for a refrigerator, comprising an ice mold for receiving water and freezing the water to ice; and a heater for separating the ice from an inner surface of the ice mold by uniformly heating an entire surface of the ice mold.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
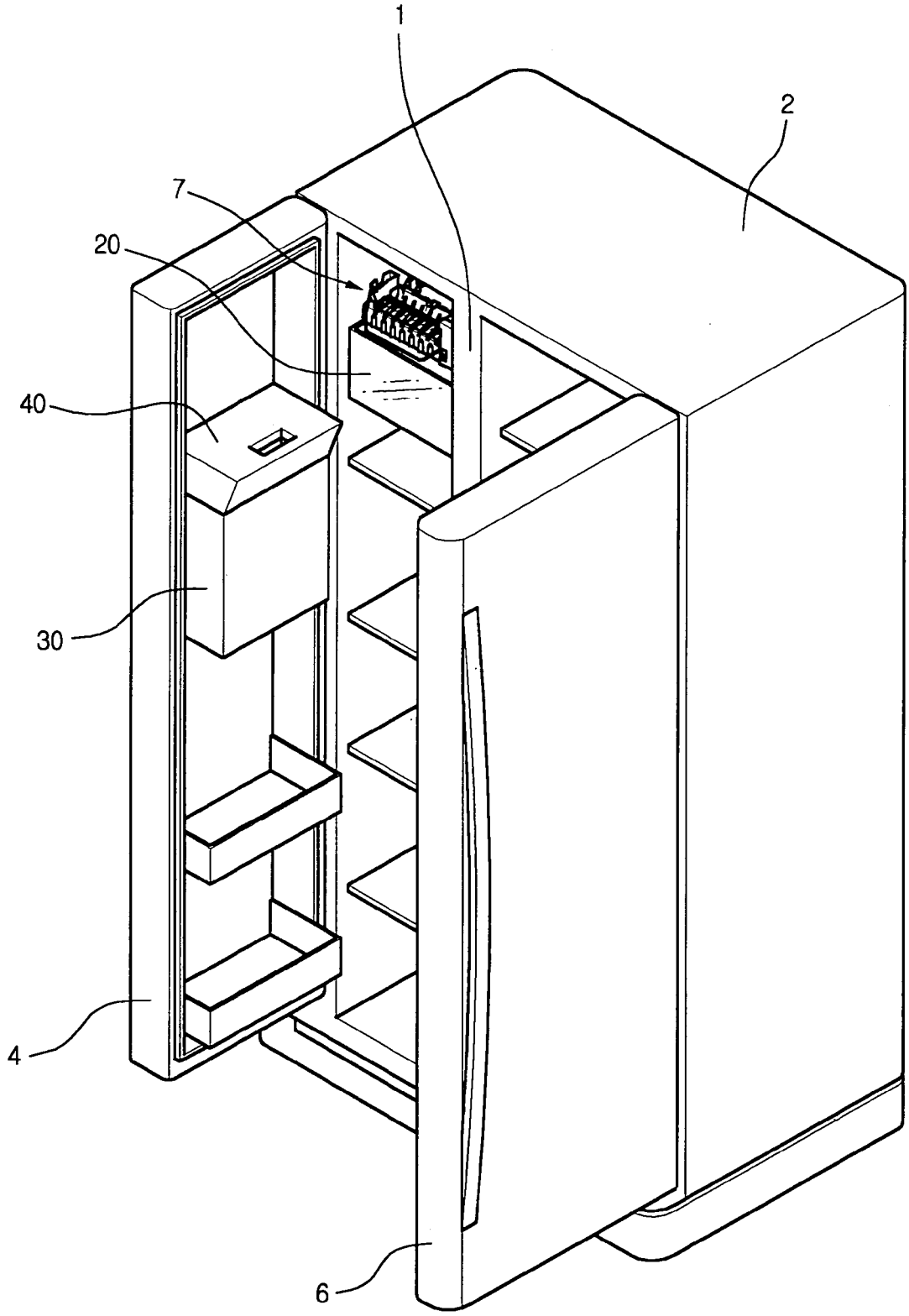
FIG. 1 is a refrigerator according to the related art.
Figure 2:
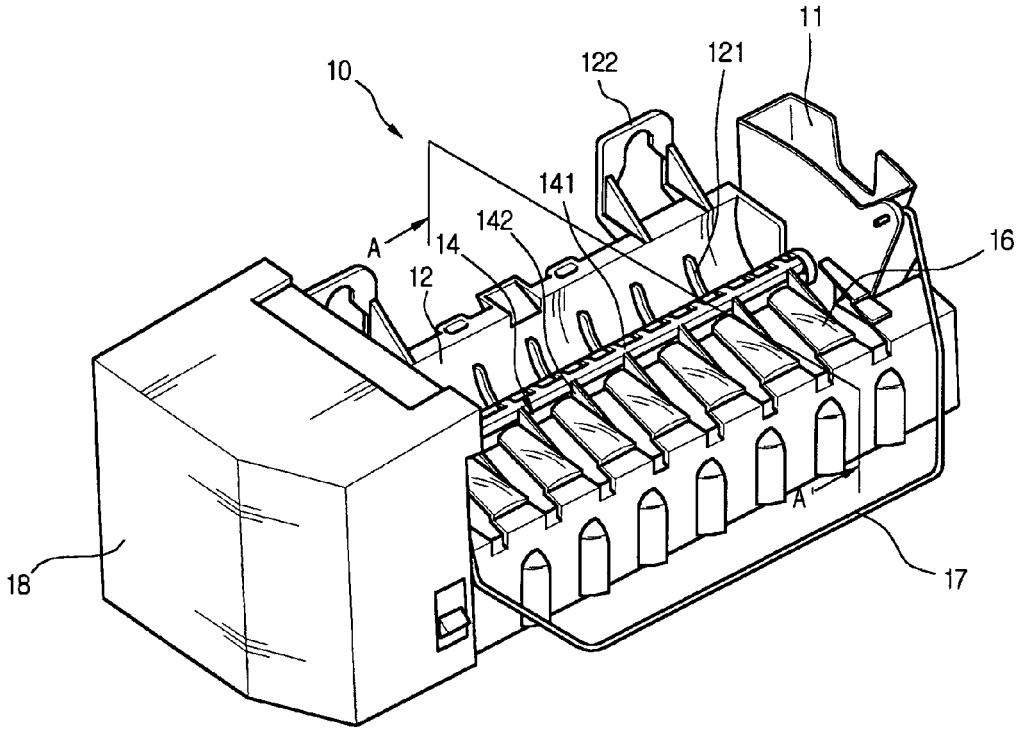
FIG. 2 is a perspective view of an icemaker according to an embodiment of the present invention.
Figure 3:
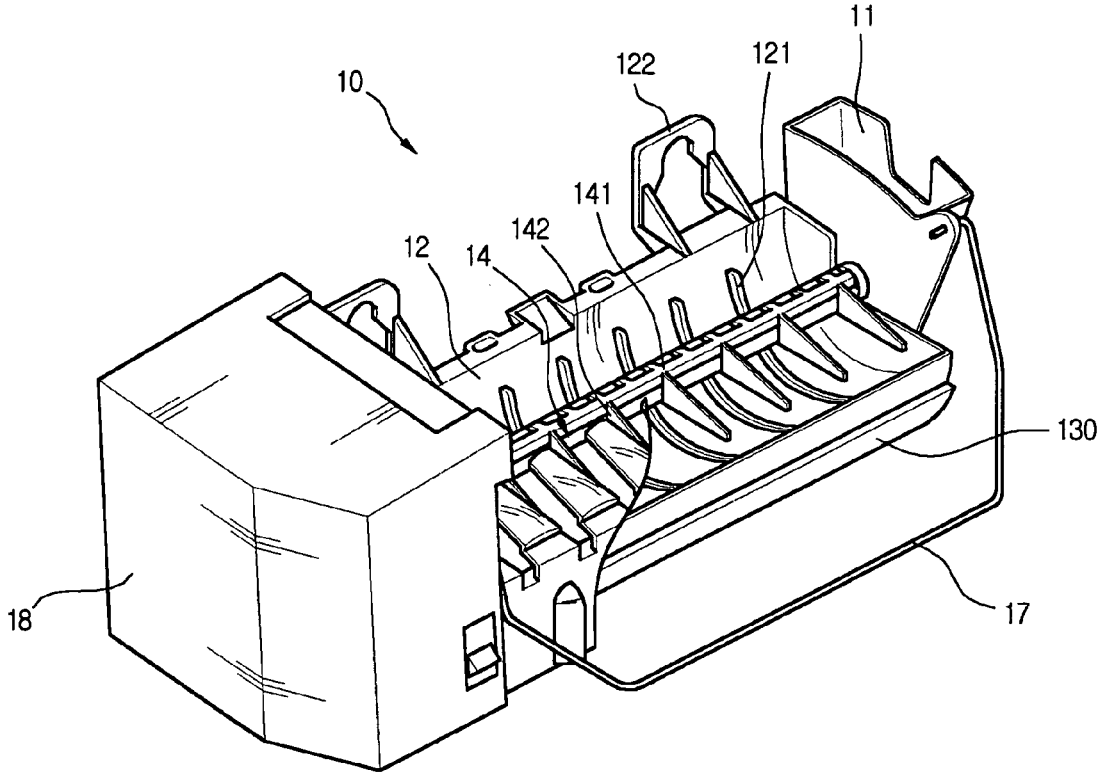
FIG. 3 is a partially broken perspective view of an icemaker according to an embodiment of the present invention.

FIGS. 2 and 3 show an icemaker according to an embodiment of the present invention.

Referring to FIGS. 2 and 3, an icemaker 10 comprises a cup 11 for storing water fed from a water supply hose (not shown), an ice mold 12 for receiving the water from the cup 11 and freezing the water using cool air in a freezing compartment, a heater 130 for heating the ice mold 12 to separate pieces of the ice, the heater 130 being mounted on the ice mold 12, an ejector 14 for ejecting the pieces of the ice out of the ice mold 12, the ejector 14 being pivotally mounted on the ice mold 14, a motor (not shown) for generating torque for driving the ejector 14, a slider 16 for directing the pieces of the ice ejected by the ejector 14 to the ice bank 20, a detecting lever 17 for detecting the ice bank 20 fully filled with the pieces of the ice, a controller 18 for, in accordance with whether the ice bank 20 is fully filled with the pieces of the ice, controlling a temperature of the ice mold 12, the operations of the heater 130, the motor, and a water supply valve controlling the water supply to the cup 11.

The ice mold 12 is provided with a space in which the water is frozen and a plurality of partition 121 for dividing the space into a plurality of freezing sections to make the pieces of the ice. The ice mold 12 is further provided at a rear end with connection parts 122 for fixing the icemaker 10 on a rear wall of the freezing compartment.

The ejector 14 comprises a pivoting shaft 141 installed on the ice mold 12 and pivoted by the torque of the motor and a plurality of scoops 142 extending from the pivoting shaft 141. The number of the scoops 142 is identical to that of the freezing sections divided by the partitions 121. The scoops 142 are located in the respective freezing sections to scoop the corresponding pieces of the ice out of the freezing sections. The motor is installed in the controller 18 disposed on a side of the ice mold 12 and is connected to the pivoting shaft 141.

The controller 18 may be provided with a temperature sensor for detecting a temperature of the ice mold 12 and an ice detecting sensor for detecting a rotating position of the detecting lever 17 to determine if the ice bank is fully filled with the pieces of the ice.

The heater 130 may be formed of an induction heater that can uniformly heat the ice mold 12.

The operation of the icemaker will be briefly described hereinafter.

The water is first fed to the ice mold 12 via the cup 11 and is then frozen, after which a surface of the frozen water is uniformly heated by the heater 130 such that the pieces of the ice can be separated at a surface where they contact the ice mold 12. Then, the pieces of the ice are ejected out of the ice mold. That is, as the pivoting shaft 141 pivots, the pieces of the ice are scooped by the scoops 142. The scooped pieces of the ice are stacked in the ice bank 20 along the slider 16.

Figure 4:
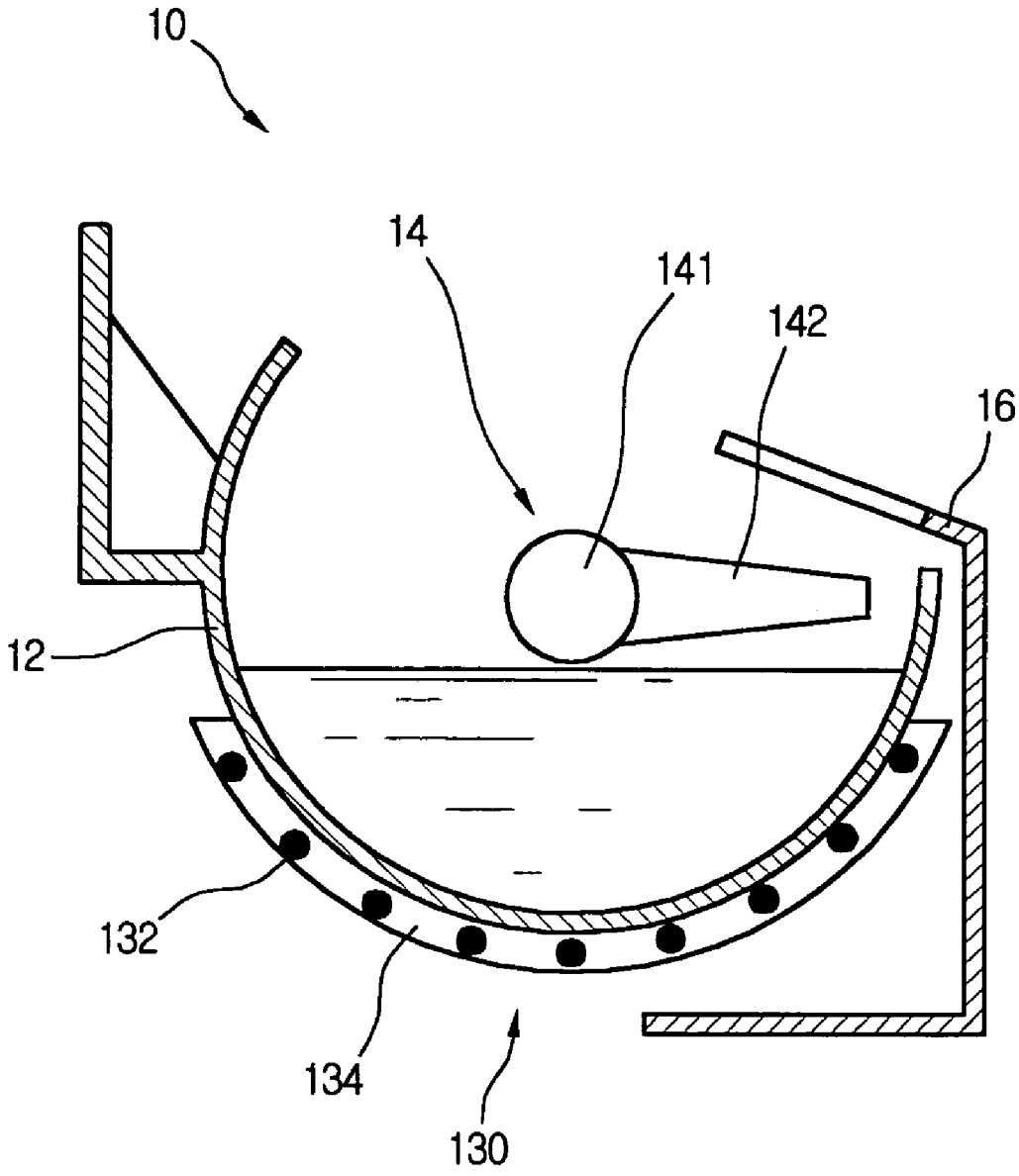
FIG. 4 is a sectional view taken along line A-A' of FIG. 2.

FIG. 4 is a sectional view taken along line A-A' of FIG. 2.

As shown in the drawing, there are shown the ice mold 12, the ejector 14 and the slider 16. The heater 130 is disposed on a circumferential outer bottom of the ice mold 12. The heater 130 is designed to be heated by an induction heating manner.

That is, the heater 130 comprises a heating coil generating eddy current by high frequency current applied from an external side to convert the electric energy into the thermal and a heater body 134 in which the heating coil is buried, the heater body 134 being formed in a circular arc shape to enclose the circumferential outer bottom of the ice mold 12. The heater body 134 separates the pieces of the ice 21 from the inner surface of the ice mold 12 using induction energy inducted from the heating coil 132.

An induction heating principle will be described hereinafter with reference to the accompanying drawings.

Figure 5:
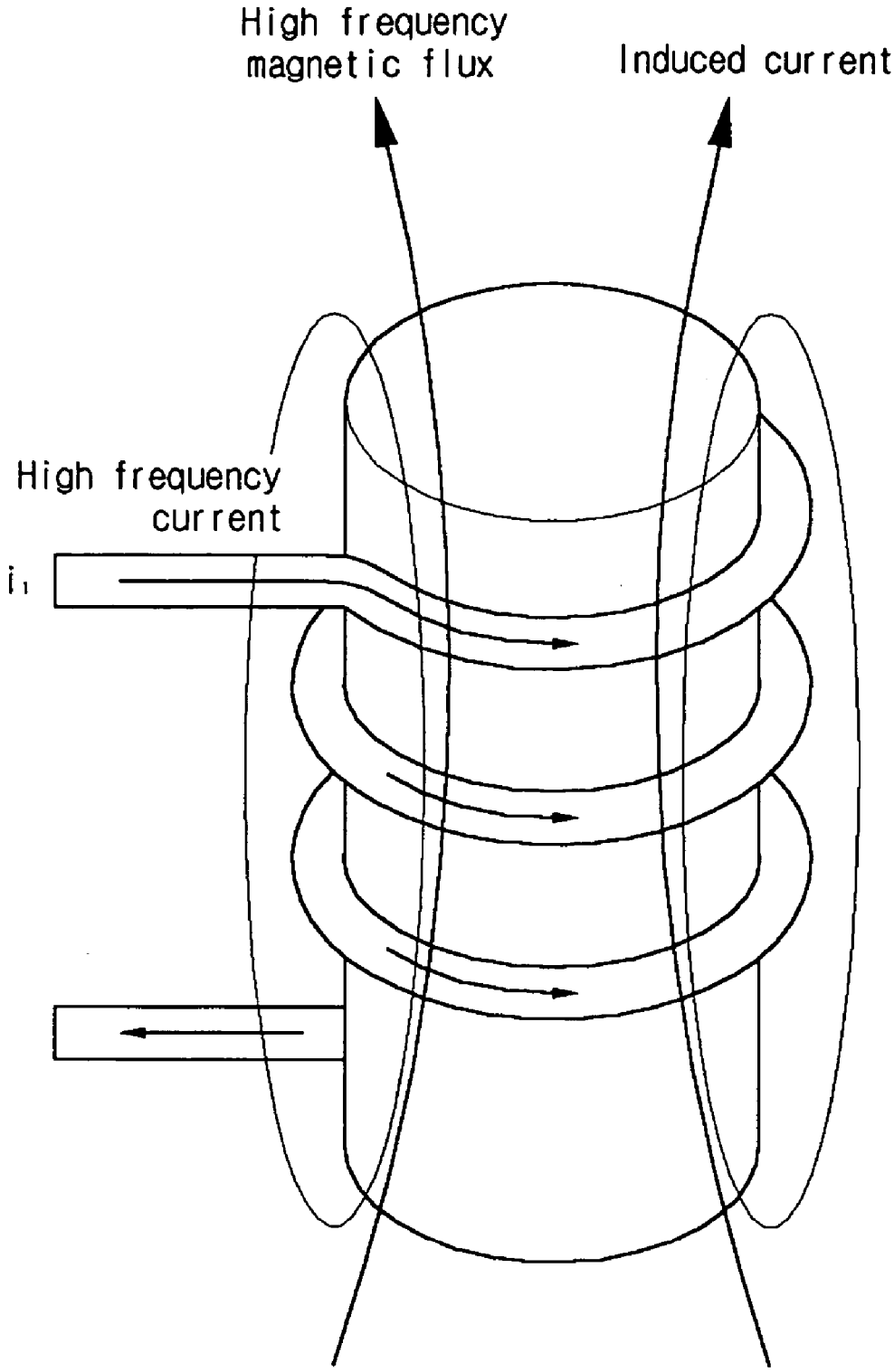
FIG. 5 is a view illustrating an induction heating principle.
Figure 6:
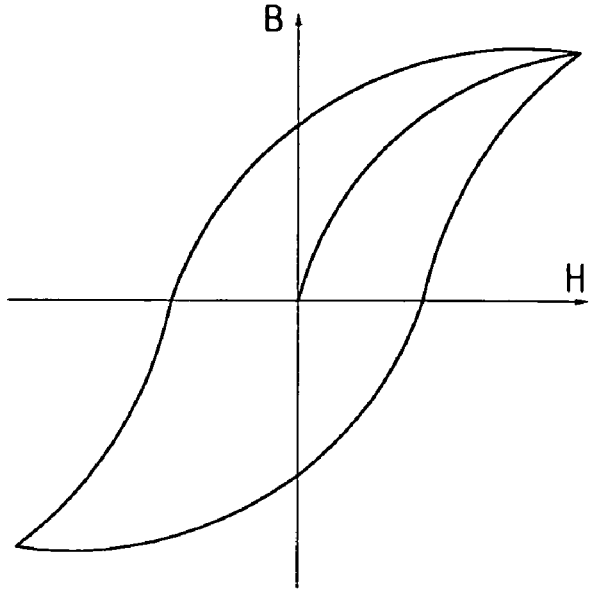
FIG. 6 is a hysteresis loop according to an induction heating.

FIG. 5 is a view illustrating an induction heating principle, and FIG. 6 is a hysteresis loop according to an induction heating.

Referring first to FIG. 5, an electric conductor in a coil along which alternating current (high frequency current) flows generates heat by an eddy current loss and a hysteresis loss (in case of a magnetic body). That is, the induction heating is realized by such heat generated by the eddy current loss and the hysteresis loss. Particularly, a high frequency induction heating uses high frequency current.

At this point, as shown in FIG. 5, alternating magnetic flux (high frequency magnetic flux) is generated in a coil along which alternating current (high frequency current) i1 and induced current (induced electromotive force) is generated in the electric conductor in a magnetic field. Particularly, the current generated by the electromotive force is called eddy current. When the eddy current flows along the electric conductor (to-be-heated-object) having a predetermined amount of resistance, the electric conductor generates the Joule heat. This is called the eddy current loss that will be a primary heat source in the induction heating. The eddy current loss can be illustrated as the following formula according to Joule's law.

$We = ne\ f^2\ Bm^2$ (ne: a constant, f: frequency, Bm: a magnetic flux density)

As illustrated by the formula, the eddy current loss is proportional to the square of the frequency. Therefore, when the frequency is higher than 100 kHz, the heating is realized by the eddy current loss. When the frequency is less than 100 kHz, the heating is realized by the hysteresis loss.

When the to-be-heated-object is formed of magnetic material and alternating current is applied to a heating coil wound around the to-be-heated object, the to-be-heated-object is magnetized. At this point, when intensity of the magnetic field is gradually increased, a curve representing the variation of the magnetic flux density B is not identical to that representing the magnetic field intensity H. That is, as shown in FIG. 6, a loop shape is defined by the curves, providing a hysteresis phenomenon. This loop shape is called a hysteresis loop.

Particularly, the larger the area defined by the hysteresis loop, the higher the hysteresis loss. That is, as the area defined by the hysteresis loop is increased, the high frequency induction heating efficiency is increased in the induction heating. This can be illustrated as the following formula.

$Wh = nh\ f\ Bm1.6\ (wb/m^2)$ (nh: a constant of applied metal core, f: frequency, and Bm: magnetic flux density)

When the frequency is increased above 50 kHz, since the eddy current loss proportional to the square of the frequency becomes greater than the hysteresis loss. In addition, when the frequency is further increased, the hysteresis loss may be almost ignored. When magnetic or nonmagnetic material such as Cu or Al is heated above a transformation point, the hysteresis loss does occur. That is, the heating is realized only by the eddy current loss.

In the present invention, the heating body 134 functions as the electric conductor along which induced current flows when alternating current is applied to the heating coil 132.

The separation process of the ice from the ice mold 12 will be described hereinafter with reference to the accompanying drawings.

Figure 7:
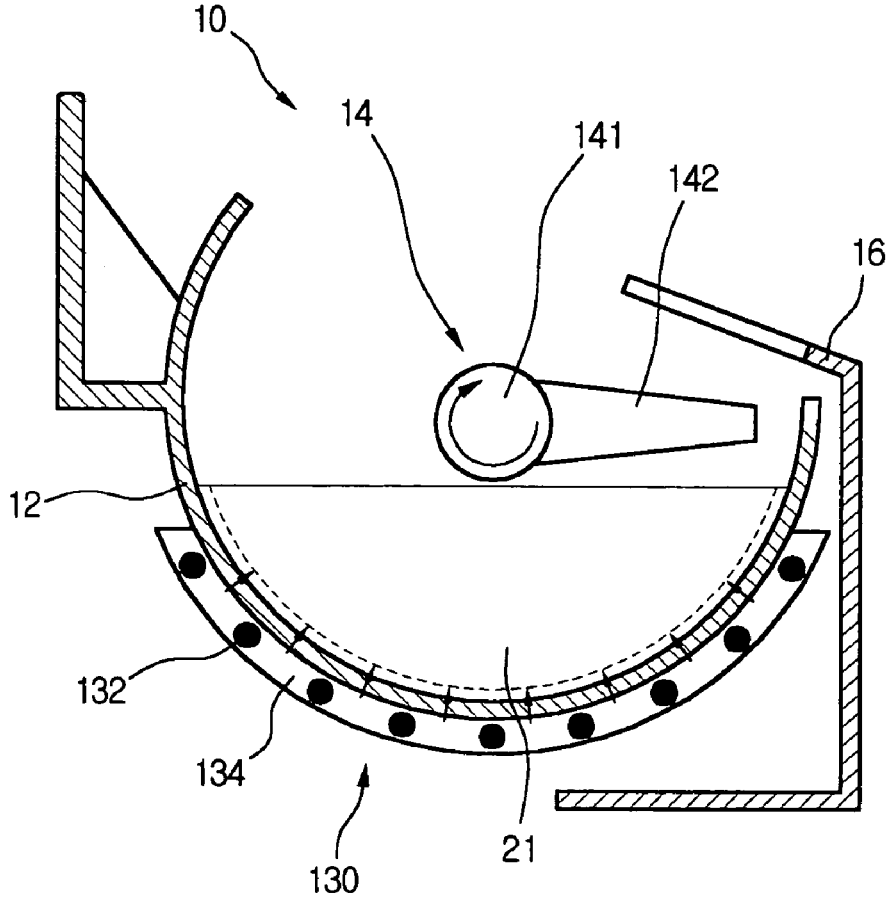
FIGS. 7 and 8 are views illustrating a process for separating ice from an icemaker using a heater.
Figure 8:
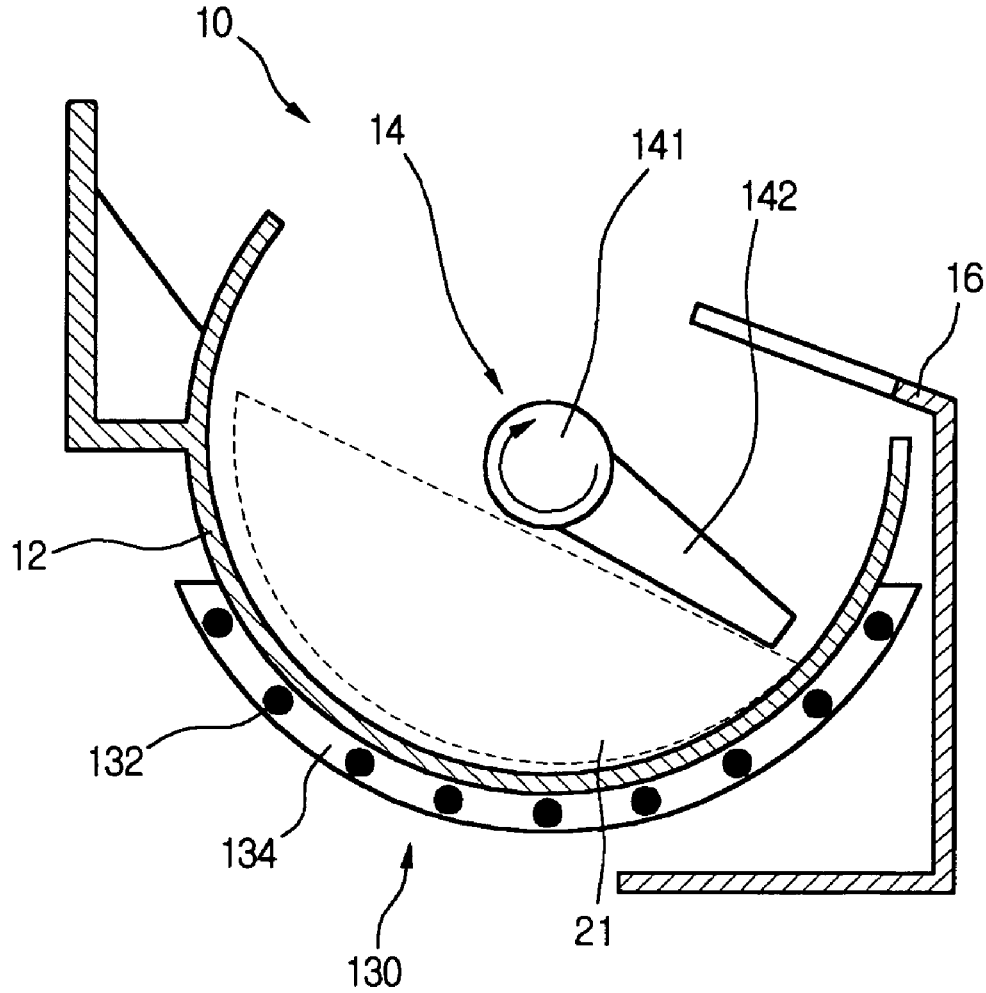

FIG. 7 shows a heating process by the heater 130 before the ejector 14 is operated, and FIG. 8 shows an ejecting process by the ejector 14 after the ice is separated from the inner surface of the ice mold 12.

Referring first to FIG. 7, when the water is completely frozen in the ice mold 12 to form the ice 21, the ice 21 is closely adhered to the inner surface of the ice mold 12. In order to separate the ice 21 from the inner surface of the ice mold 12, electric power is applied to the heater 130 disposed on the circumferential outer bottom of the ice mold 12.

That is, when the electric power is applied to the heater 130, eddy current is generated by the heating coil of the heater 130. The eddy current flows along the heater body 134 to covert the electric energy into the thermal energy, thereby generating the Joule heat in the heater body 134. At this point, since the eddy current flows through the entire area of the heater body 134, the heater body 134 uniformly generates the heat through its entire area.

When the ice mold 12 is uniformly heated by the heat uniformly generated through the entire area of the heater body 134, as shown in FIG. 7, the adhering portion of the ice to the inner surface of the ice mold 12 uniformly melts, making it easy to quickly separate the ice from the ice mold 12. As described above, since the ice mold 12 is uniformly heated by the induction heating manner, the ice 21 can be more quickly separated from the ice mold 12.

When the adhering portion of the ice to the inner surface of the ice mold 12 melts, as shown in FIG. 8, the shaft 141 of the ejector 14 is rotated by the motor such that the scoop 142 can scoop the ice 21 out of the ice mold 12, thereby directing the ice 21 to the ice bank 20.

Meanwhile, the heating coil 132 is buried in the heater body 134. However, the present invention is not limited to this case. That is, the heating coil 132 may be formed on a surface of the heater body 134 in a predetermined pattern. Preferably, the heater body 134 is formed of metal having a predetermined amount of resistance, and the heating coil 132 is formed in a predetermined pattern having a uniformly spaced line through the entire area of the heater body 134. In addition, the heater body 134 is designed corresponding to the circumferential outer bottom of the ice mold 12 so that the heat conduction can be quickly realized.

When the ice mold 12 is formed of conductive material such as metal, the heat generated by induction heating can be directly transmitted to the ice, making it possible to more quickly make the ice. In this case, the induced heating coil may be directly formed on an outer surface of the ice mold 12.

The above-described icemaker can be applied to a side-by-side type refrigerator as well as freeze-top-type refrigerator.

In the icemaker of the present invention, since the ice mold 12 is uniformly heated by the induction heating manner, the pieces of the ice 21 can be more quickly separated from the ice mold 12, being formed in an identical shape.

Furthermore, the electric power used for the ice separation as well as the ice making time can be saved.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An icemaker for a refrigerator, comprising:

an ice mold that receives water and is configured to freeze the water to form ice;

an ejector pivotally installed on the ice mold and having an extension protrusion to eject the ice out of the ice mold;

a motor that operates the ejector; and a heater comprising:

a generally circular arc shape heater body having a constant curvature extending in a circumferential direction of the heater body, the heater body comprising metal and provided at a circumferential outer bottom surface of the ice mold, the heater body uniformly heating the ice mold to separate the ice from an inner surface of the ice mold, wherein the heater body has a generally uniform thickness in a radial direction of the heater body and heat is uniformly generated through generally an entire area of the heater body; and a heating coil that applies induced electromotive power to the heater body, thereby allowing the heater body to generate heat, and the heating coil comprising lines uniformly spaced throughout the entire circumferential direction of the heater body.

2. The icemaker according to claim 1, wherein the heating coil is embedded in the heater body.

3. The icemaker according to claim 1, wherein the heating coil is formed in a predetermined pattern having lines spaced from each other at a predetermined distance.

4. The icemaker according to claim 1, wherein the heater body surface-contacts the ice mold.

5. The icemaker according to claim 1, wherein the heating coil is formed on a surface of the ice mold.

6. The icemaker according to claim 1, wherein the heater body consists essentially of metal.

7. An icemaker for a refrigerator, comprising:

an ice mold that receives water and is configured to freeze the water to form ice;

a heater comprising metal, wherein the heater is configured to uniformly heat an outer circumferential bottom surface of the ice mold proximate an area where the ice contacts the inner surface of the ice mold, wherein the heater is configured to perform induction heating by an induced electromotive power applied from an external side, wherein the heater has a generally circular arc shape and a generally uniform thickness in a radial direction of the heater such that heat is generated uniformly though generally an entire area of the heater and is provided on an outer surface of the ice mold, and wherein the heater has a constant curvature extending in a circumferential direction of the heater; and a heating coil comprising lines uniformly spaced throughout the entire circumferential direction of the heater.

8. The icemaker according to claim 7, wherein the heater surface-contacts the ice mold at a surface having the same shape.

9. The icemaker according to claim 7, wherein the heater comprises:

a heater body that generates heat; and the heating coil embedded in the heater body to apply induced electromotive power to the heater body.

10. The icemaker according to claim 7, wherein the heater comprises:

a heater body formed corresponding to the outer surface of the ice mold to surface-contact the outer surface of the ice-mold, the heater body uniformly generating heat through an entire area of the heater body; and the heating coil that applies induced electromotive power to the heater body.

11. The icemaker according to claim 7, wherein the ice mold is formed of conductive material.

12. The icemaker according to claim 7, wherein the heater comprises:

a conductive heater body; and the heating coil comprises an induction heating coil for applying induced electromotive power to the heater body.

13. An icemaker for a refrigerator, comprising:

an ice mold that receives water and is configured to freeze the water to form ice;

a heater comprising metal, wherein the heater is configured to separate the ice from an inner surface of the ice mold, the heater uniformly heating an entire surface of the ice mold by using induction heating, wherein the heater has a generally circular arc shape and a generally uniform thickness in a radial direction of the heater such that heat is generated uniformly through generally an entire area of the heater and is provided on an outer surface of the ice mold, and wherein the heater has a constant curvature extending in a circumferential direction of the heater; and a heating coil comprising lines uniformly spaced throughout the entire circumferential direction of the heater.

14. The icemaker according to claim 13, wherein the heater comprises:

the heater body disposed on a side of the ice mold; and an induction heating coil disposed adjacent to the heater body to apply induced electromotive power to the heater body.

15. The icemaker according to claim 13, wherein the heater comprises an induction heating coil.

16. The icemaker according to claim 13, wherein the ice mold is formed of metal.

17. The icemaker according to claim 13, wherein the heater comprises:

the heater body disposed on a side of the ice mold; and an induction heating coil embedded in the heater body to apply induced electromotive power to the heater body.

* * * * *

UNITED STATES PATENT AND TRADEMARK OFFICE

CERTIFICATE OF CORRECTION

PATENT NO. : 7,493,776 B2
APPLICATION NO. : 10/957962
DATED : February 24, 2009
INVENTOR(S) : H. K. Lim et al.

It is certified that error appears in the above-identified patent and that said Letters Patent is hereby corrected as shown below:

At column 6, line 55 (claim 7, line 13) of the printed patent, "though" should be --through--.

Signed and Sealed this

Twenty-second Day of September, 2009

David J. Kappos

David J. Kappos
*Director of the United States Patent and Trademark Office*